United States Patent [19]

Ibbott

[11] Patent Number: 4,484,101

[45] Date of Patent: Nov. 20, 1984

[54] SPARK PLUG

[76] Inventor: Jack K. Ibbott, 17-7, Nishiazabu 4-chome, Minato-ku, Tokyo 106, Japan

[21] Appl. No.: 293,226

[22] PCT Filed: Dec. 25, 1980

[86] PCT No.: PCT/JP80/00329

§ 371 Date: Aug. 12, 1981

§ 102(e) Date: Aug. 12, 1981

[87] PCT Pub. No.: WO81/01918

PCT Pub. Date: Jul. 9, 1981

[30] Foreign Application Priority Data

Dec. 28, 1979 [JP] Japan ..... 54-173877

[51] Int. Cl.[3] ..... H01T 13/20

[52] U.S. Cl. ..... 313/142

[58] Field of Search ..... 313/141, 142, 143

[56] References Cited

U.S. PATENT DOCUMENTS

| | | | |
|---|---|---|---|
| 1,538,870 | 5/1925 | Champion | 313/141 X |
| 1,564,645 | 12/1925 | Thomas | 313/143 X |
| 2,591,718 | 4/1952 | Paul | 313/143 X |
| 2,895,069 | 7/1959 | Davis | 313/143 |
| 4,267,481 | 5/1981 | Sauder | 313/141 X |

FOREIGN PATENT DOCUMENTS

| | | |
|---|---|---|
| 108968 | 3/1939 | Australia . |
| 232675 | 10/1958 | Australia . |
| 403748 | 10/1965 | Australia . |
| 160154 | 3/1920 | United Kingdom . |
| 303549 | 1/1929 | United Kingdom . |
| 737117 | 1/1953 | United Kingdom . |

*Primary Examiner*—Palmer Demeo
*Assistant Examiner*—Sandra L. O'Shea
*Attorney, Agent, or Firm*—Wenderoth, Lind & Ponack

[57] ABSTRACT

An improved spark plug is provided wherein a part of a ground electrode facing an exposed end part of a central electrode is angled to the vertical and horizontal planes of the spark plug so as to deflect the movement of a flame front into a swirling movement.

7 Claims, 9 Drawing Figures

SPARK PLUG

BACKGROUND OF THE INVENTION

This invention relates to an improvement of a spark plug for an internal combustion engine.

Various kinds of spark plugs have been provided hitherto in which the standard spark plug now in use in most of cars has a ground electrode rectangular-shape in cross section. The ground electrode is welded to the upper end of a cylindrical outer metal part of the plug and is bent such that the free end portion thereof becomes substantially parallel to the terminal end of the central electrode.

In an internal combustion engine, when ignition of the combustible gases occurs with such standard spark plug, the burning gases are forcibly ejected from the area of the spark, and they are ejected away from the plug in straight paths. This straight movement of the burning gases (flame front) will normally continue in the direction it is ejected from the spark plug area, but will divert in various directions as it meets non-combustible areas of gas, and will follow a path of the most highly combustible gases. This means that although the gas was ejected in a straight path from the spark plug, this path will consist of a series of diverted paths away from the initial direction.

When the flame front of the burning gases meets the cylinder walls and top of the piston, it will then be reflected in various directions, depending on the shape of the surface it strikes, and will be set into a form of swirling action. However, as the speed of the flame front has considerably reduced by this time, the degree of swirling action developed as a result of the shape of the cylinder (combustion chamber) walls and the piston top is accordingly less intense, and quickly dissipates so that little of this swirling action is residual by the time the next intake of combustible gas and firing occurs.

Another factor is that the electrode causes a "shadow" in the flame front. That is the burning gases being ejected away from the spark plug, and being in a straight path, do not swirl around the back of the electrode, and a shadow is left. This can be compared with a beam of light and an object placed in the path of the light beam, immediately behind the object there is almost no light, and this dark area is termed a shadow. In the case of the standard spark plug electrode, this area of shadow behind the electrode becomes a delayed firing area and causes irregularities in the smooth burning and resulting power available from the combustion of the fuel.

Also, in an internal combustion engine, the piston on the upward exhaust stroke causes the burnt gas from the combustion of the fuel to be pushed (exhausted) out of the cylinder through the open exhaust valve. However, the elimination of all burnt gas from the cylinder is not possible because the piston does not fully contact the cylinder top, and there is always a space between the top of the piston and the top of the cylinder when the piston is at the maximum upward position. Therefore, there is always this residual amount of burnt (non-combustible) gas remaining in the cylinder.

When the piston goes into the intake stroke and draws the fuel and air mixture into the cylinder, this residual non-combustible gas partly mixes with the combustible fuel and air mixture. However, some pockets or areas of the non-combustible gas remain unmixed with the combustible mixture. When the piston comes up to the compression stroke for firing of the fuel at the top of the stroke when the fuel is compressed, the combustible mixture of fuel and air is ignited by the spark plug. If the combustible mixture of fuel and air is surrounding and in the gap of the spark plug when the spark is caused to occur across the gap, ignition of the fuel and air mixture will be immediate. However, as explained above there are some remaining pockets of almost only the residual non-combustible gas, and if this pocket of non-combustible gas is in the spark gap or in the immediate vicinity, ignition of the combustible mixture of fuel and air will not occur because it is isolated from the spark by the area of non-combustible gas, and accordingly a misfire or late fire will occur.

The above described condition occurs mostly at low engine speeds when the movement of gases within the cylinder is relatively slow and the mixing of the residual non-combustible gas with the combustible fuel and air mixture is only partial. Many methods have been devised to overcome this problem, such as specially designed shapes of the top of the cylinder and the piston head. The positioning of the exhaust valve and the intake valve also play an important part in endeavours to overcome this problem. Some of these methods have provided improvement but have not completely solved the problem. Therefore, even in the most effectively designed engine the effect of the residual non-combustible gas still shows up as unstable engine speeds and irregular firing at low engine speeds, and especially so at idle speeds.

The inventor has been aware of this condition for a considerable time, and during the progress of research on the development of low pollution carburetors found this problem becoming increasingly more troublesome as the optimum mixture of fuel and air for low pollution combustion was approached. This unstable firing condition became a barrier to the final approach of low pollution without the use of catalysts, etc. As a result of investigations into this problem it became apparent that the residual non-combustible gas must be kept away from the area of the spark plug or be thoroughly mixed by some means with the combustible mixture of fuel and air, and by such mixing the effect of irregular firing would be eliminated.

Accordingly, an object of the present invention is to provide a spark plug which allows the smooth burning of an air and fuel mixture without causing a substantial shadow in the flame front in the combustion chamber.

Another object of the present invention is to provide a spark plug which causes an integral mixing of the non-combustible residual gases in the combustion chamber with the new charge of combustible fuel and air mixture and thereby provides regular and even firing of the new fuel/air charge.

A further object of the present invention is to provide a spark plug which causes an increase of power of an engine with less consumption of the fuel.

A still another object of the present invention is to provide a spark plug which is easily adapted to almost all internal combustion engines now in use.

A further object of the present invention is to provide a spark plug which is simple in structure and inexpensive to manufacture.

BRIEF SUMMARY OF THE INVENTION

In view of all the research and special methods which have been used to provide special shaping of the piston top and cylinder top, and the fact that none of these have been completely effective, the inventor decided that the most practical area to cause the mixing of the residual non-combustible gas with the combustible fuel and air mixture would be at the spark plug itself, and by some means to cause a strong swirling action of the gases around and through the gap of the spark plug. After due consideration it was thought that any swirling action which could be caused by the firing of the fuel itself would continue in the burning gases after the initial ignition up to the time of the completed exhaust stroke, and also still be effective on the incoming fuel air mixture during the intake stroke, or part of that stroke, and by so doing would cause an even mixing of the residual non-combustible gas with the combustible fuel air mixture, and also improved mixing of the fuel and air.

As a quick approach to this idea and as a simple test to prove the principle, the spark plugs were removed from an engine and by using a pair of pliers the ground electrode of each plug was twisted in the manner of a propellor blade. When the engine was started using the spark plugs with the twisted electrode the result was most noticeable, and the irregular firing and instability of the engine at idle was considerably improved. This quick test proved the inventor's theory that the swirling of the gas from the time of ignition would continue for a considerable period of time during the following cycle of the engine. Based on this finding the inventor then proceeded to make various designs of spark plug structure by which a strong swirling action would emanate from the ignition area of the spark plug and spread throughout the whole area of combustion. It became obvious that several methods could be employed to provide the necessary swirling action, but the most effective and simple to construct was the spark plug electrode, and it was found when a part of the ground electrode facing to the end of the central electrode is angled relative to the vertical and horizontal planes of the spark plug, a very effective swirling of the gases could be caused in the cylinder. As employed herein, the term "vertical plane" refers to a plane containing the longitudinal axis of the central electrode and, when such part of the ground electrode facing the end of the central electrode extends radially of the central electrode, also containing the radial center of such part, and the term "horizontal plane" refers to a plane extending transversely to the longitudinal axis of the central electrode.

Preferably, the ground electrode is formed by twisting like a propellor blade at the part facing the end of the central electrode.

More preferably, the ground electrode is formed from an L-shaped flat faced metal piece or a plurality of such metal pieces. The metal piece is attached at one end thereof to a threaded cylindrical metal part of the plug with such an inclination that the attached end thereof is directed in a direction parallel to a tangent to the cylindrical surface of the central electrode and that the other free end portion thereof extends in a direction radially of the central electrode.

The aforementioned and other objects and features of the present invention shall be described hereinafter in detail with reference to preferred embodiments thereof shown in the accompanying drawings, in which:

DETAILED DESCRIPTION OF THE INVENTION

In the course of the developmental work and testing of the present invention, the inventor noted that when a ground electrode of a spark plug is modified so as to cause a swirling action in the gases within the combustion chamber following the ignition of the combustible fuel and air mixture, many disadvantages set forth above and experienced in the conventional spark plugs could be eliminated. The advantageous phenomena of the swirling action shall be described hereinafter in detail. However, before that, various embodiments of the present spark plug which causes swirling action in the gas shall be described.

Figure 1:
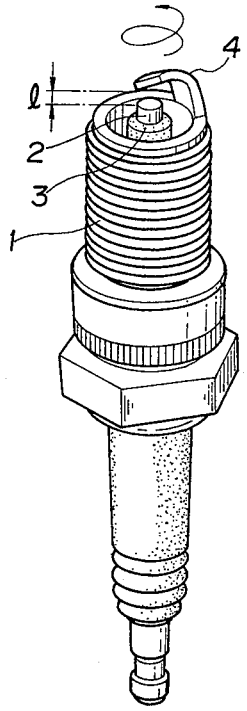
FIG. 1 is a perspective view showing a spark plug according to a first embodiment of the present invention.

As shown in the first embodiment of FIG. 1, a spark plug of the present invention comprises, just as the standard spark plug, a threaded cylindrical metal part or body 1, a central electrode 2 provided concentrically within the metal part 1, and a dielectric substance 3 such as ceramic provided between the metal part 1 and the central electrode to electrically isolate them from each other.

According to this first embodiment, a ground electrode 4 is formed by the simple twisting of the standard ground electrode to give it the form of one blade of a propellor. Preferably, the angle of the twisting at the free end portion of the ground electrode 4 shall be in a suitable range about the optimum of 45° of approximately 25 to 60 degrees relative to the horizontal plane, and is acute with respect to a radial plane through the longitudinal axis of central electrode 2. The minimum gap "l" between the central electrode 2 and the ground electrode 4 may be the same width as that of the standard spark plug. However, the gap "l" of the present spark plug can be much wider than that of the standard spark plug due to improved mixing of air and fuel.

Figure 2:
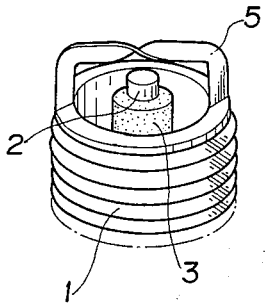
FIG. 2 is a fragmentary perspective view showing a spark plug according to a second embodiment of the present invention.
Figure 3:
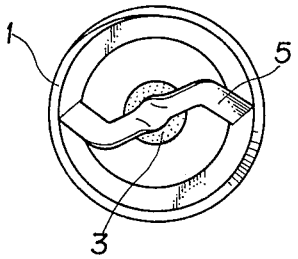
FIG. 3 is a plan view of the spark plug shown in FIG. 2, FIG. 4 and FIG. 5 are fragmentary perspective views showing spark plugs according to third and fourth embodiments of the present invention, respectively.

In a second embodiment of the present invention shown in FIGS. 2 and 3, a ground electrode of the standard type spark plug was removed and, in place of the removed electrode, a new twisted ground electrode 5 is attached to the upper end of the metal part 1. This ground electrode is prepared from a metal strip of the same material as used in the standard spark plug and twisted like a propellor blade in such a manner that the ground electrode bridges over the central electrode 2.

Figure 4:
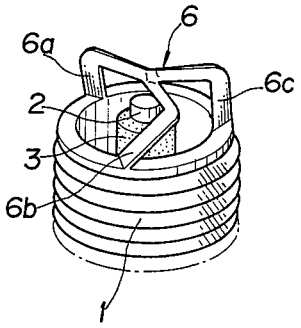

Referring to a third embodiment of the present invention shown in FIG. 4, a three-legged electrode 6 is provided as a ground electrode in place of a conventional inverted L-shaped ground electrode of the standard spark plug. Each of the leg portions 6a, 6b and 6c is twisted especially at the upper portion thereof and joined together at the center portion above the central electrode 2.

Figure 5:
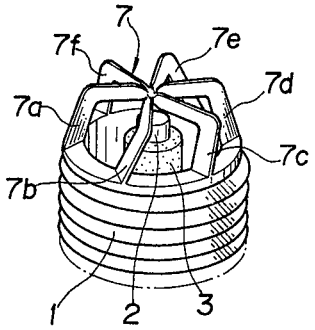

In a fourth embodiment of the present invention shown in FIG. 5, a six-legged electrode 7 is provided as a ground electrode of the spark plug. Each of the leg portions 7a–7f is twisted especially at the upper portion thereof and joined together at the center portion above the central electrode 2.

It should be noted here that, preferably, the lower ends of the leg portions of the ground electrodes in the third and fourth embodiments are attached to the upper end of the metal part 1 in directions parallel to tangents to the cylindrical surface of the central electrode 2.

In the embodiments set forth above, the ground electrodes 4, 5, 6 and 7 were formed by twisting the elements thereof. However, it is possible, without twisting the ground electrode, to provide a spark plug which causes a swirling action in the gases within the combustion chamber. In the following embodiments of the present invention, no twist is provided in the ground electrode.

Figure 6:
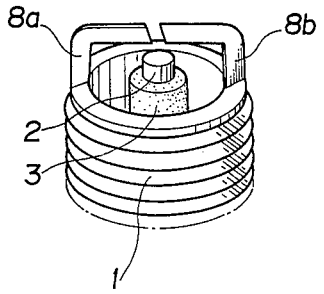
FIG. 6 is a fragmentary perspective view showing a spark plug according to a fifth embodiment of the present invention.
Figure 7:
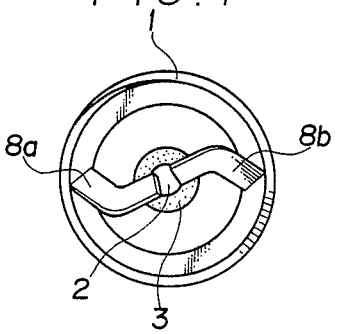
FIG. 7 is a plan view of the spark plug shown in FIG. 6, and FIG. 8 and FIG. 9 are fragmentary perspective views showing spark plugs according to sixth and seventh embodiments of the present invention, respectively.

In a fifth embodiment of the present invention shown in FIGS. 6 and 7, a pair of ground electrodes 8a–8b are attached with a predetermined degree of inclination on the upper end of a metal part 1. These electrodes 8a–8b are formed by punching from a relatively thin metal sheet of nickel alloy members in the shape of "L". Each electrode is attached in the inverted L-shape in such a manner that the lower end of the electrode is directed in a direction parallel to a tangent to the cylindrical surface of the central electrode 2. Also, the electrode is inclined relative to the vertical plane of the plug such that the upper horizontal part of the electrode extends a direction radially of the central electrode 2. These two electrodes 8a–8b are provided symmetrically relative to the central electrode with a small spacing between the free ends thereof.

Figure 8:
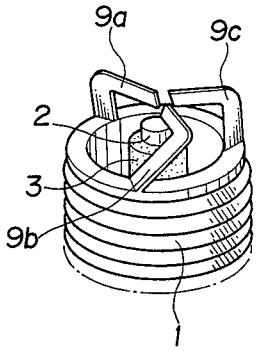

In a sixth embodiment of the present invention shown in FIG. 8, three ground electrodes 9a–9c are attached on the upper end of a metal part 1 with a predetermined degree of inclination (as with the fifth embodiment). These electrodes 9a–9c are equally separated from each other in the circumferential direction of the metal part 1 and attached to incline in the same manner as mentioned above with the fifth embodiment. That is, the lower end of each electrode is directed in a direction parallel to a tangent to the cylindrical surface of the central electrode and the upper horizontal part thereof extends in a direction radially of the central electrode 2. The free ends of the ground electrodes 9a–9c are located above the central electrode but are spaced from each other with small spacings therebetween.

Figure 9:
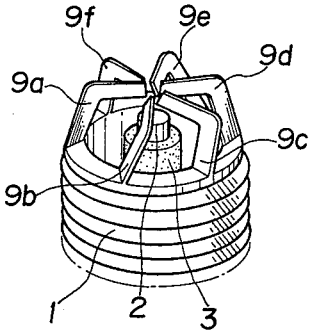

In a seventh embodiment of the present invention shown in FIG. 9, six ground electrodes 10a–10f are attached on the upper end of the metal part in a manner similar to that mentioned above regarding the sixth embodiment. That is, three additional ground electrodes are attached to the spark plug of the sixth embodiment in such a manner that all of the six electrodes are equally separated from each other in the circumferential direction of the metal part 1.

Although many embodiments of the present invention have been described, the spark plugs in the fifth to seventh embodiments shown in FIGS. 6 through 9 have some advantages over those in the first to fourth embodiments shown in FIGS. 1 to 5. One of the advantages is that the spark plugs in the fifth to seventh embodiments can be manufactured very easily, because the ground electrodes can be formed by being punched from a metal sheet and welded to the upper end of a metal part at the same inclination with each other. Another advantage is that, since the free ends of the ground electrodes are separated from each other in the spark plugs in the fifth to seventh embodiments, the temperature at the area of ignition is lower because of less restriction to the movement of the flame front such that the burning gas can travel more freely in every direction by the swirling action and also a fresh air and fuel mixture to be burnt has more free access to the ignition point between the ground and central electrodes.

Reference is now made to the swirling action of the gases in the combustion chamber caused by the use of the present spark plug. As described above when ignition of the combustible gases occurs, the burning gases are forcible ejected away from the spark plug. However in the case of the plug of this invention, the path of these burning gases is deflected by the twisted shape or inclined setting of the electrode(s). This causes an immediate swirling action of the burning gases, and as it is occurring at the initial area of ignition and combustion, the speed of travel of the burning gases is very high, and accordingly the swirling action is very severe. As the burning gases travel away from the spark plug area, the swirling action causes mixing of the still unburnt gases in the cylinder, and generates an evenly distributed burning area and flame front. Pockets of residual non-combustible gas from the previous firing are finely mixed with the combustible gases, and the combustible gases themselves are also more finely mixed.

As explained above, in the case of the standard spark plug a "shadow" is formed immediately behind the electrode and causes delayed firing in this area. In the case of the spark plug of this invention the abovementioned shadow is eliminated by the twisted shape or inclined setting of the electrode. Accordingly the flame front travelling away from the spark plug area will be evenly distributed and will not contain any pockets of delayed combustion.

The very severe swirling action generated in the burning gases is so strong that it is maintained for a relatively long period of time during the cycle of the engine, and the residual gases remaining in the cylinder at the top of the exhaust stroke will still contain some swirling action which will be then initiated into the incoming mixture of fuel and air, and by such will cause an even distribution of the residual non-combustible gas with the combustible gases and thereby eliminate the pockets of non-combustible gas which normally occur throughout the area of the combustible gas, and which quite frequently surround the area of the spark plug and cause irregular or delayed firing.

In the following a description is given of the various tests and comparisons of spark plugs of the present invention with the standard type spark plug. A set of spark plugs having the electrode form as shown in FIG. 2, when used in an engine to replace the standard spark plugs, gave exceedingly smooth engine idle and the engine idle speed increased from 650 rpm to 700 rpm.

This idle speed increase occurred with all carburetor idle adjustments being untouched from the setting necessary for the standard spark plugs. Further investigations showed the following differences between standard spark plugs and the spark plugs of this invention:

Standard spark plugs

At a specified engine idle speed the best condition was adjusted by the setting of both the idle screw and the throttle butterfly of the carburetor. Any further closing of the idle screw caused the engine to become extremely rough and complete misfiring occurred. The set idle speed of 650 rpm fluctuated widely quite frequently, and partial misfire and complete misfire could be heard from the exhaust, at which times the engine could be seen to visibly move in its flexible mounts.

Spark plugs of this invention

Without changing any of the carburetor settings which had been established for the standard spark plugs, the standard spark plugs were directly replaced with the spark plugs of this invention as shown in FIG. 2, and as mentioned previously the idle engine speed immediately increased from the set 650 rpm to 700 rpm, the engine became very smooth and notably much quieter. In order to reset the idle speed to that as recommended by the manufacturer (650 rpm) it was possible to close off the carburetor idle adjust screw by a considerable amount (almost fully closed) without loss of the smooth idle condition. The idle speed when set remained almost constant with an occasional small fluctuation. The engine remained steady and no movement could be observed, and only by carefully feeling the engine could a vibration be detected. Listening at the exhaust pipe showed a slight variation of exhaust note at infrequent occasions, however, at odd times there still remained a slight sound of an infrequent partial misfire.

Although the present invention has been described with reference to preferred embodiments thereof, many modifications and alterations may be made within the spirit of the present invention.

I claim:

1. A spark plug for an internal combustion engine and comprising:

a threaded cylindrical outer metal body having an axial end;

a central electrode positioned concentrically within said metal body;

a dielectric member positioned between said metal body and said central electrode and leaving exposed an end portion of said central electrode;

a generally L-shaped ground electrode including a first portion integrally connected to and extending from said axial end of said metal body and a second portion integral with and extending from said first portion toward said central electrode in a generally radial direction within a plane containing the longitudinal axis of said central electrode, said second portion being spaced from said central electrode and defining therewith a spark gap; and means for, upon the occurrence of ignition between said central electrode and said ground electrode at said spark gap, deflecting the resultant flame front into a strong swirling movement into a combustion chamber into which the spark plug is adapted to extend, said deflecting means comprising a generally planar surface of said second portion of said ground electrode, said planar surface being inclined at an angle of approximately 25° to 60° with respect to said plane and generally confronting said spark gap.

2. A spark plug as claimed in claim 1, wherein said second portion of said ground electrode is twisted in the manner of a propellor blade with respect to said first portion of said ground electrode and faces a free axial end of said central electrode.

3. A spark plug as claimed in claim 2, wherein said ground electrode bridges over said central electrode.

4. A spark plug as claimed in claim 1, wherein said ground electrode bridges over said central electrode.

5. A spark plug as claimed in claim 1, wherein said central electrode has a cylindrical surface, and said ground electrode is formed from an L-shaped planar metal piece which is attached at one end thereof to said metal body at such an inclination that said first portion extends in a direction parallel to a tangent to said cylindrical surface of said central electrode and such that said second portion thereof extends in a direction radially of said central electrode.

6. A spark plug as claimed in claim 1, wherein said central electrode has a cylindrical surface, and said ground electrode comprises a plurality of L-shaped planar metal pieces each attached at one end thereof to said metal body at such an inclination that said first portion thereof extends in a direction parallel to a tangent to said cylindrical surface of said central electrode and such that said second portion thereof extends in a direction radially of said central electrode, said plural metal pieces being separated from each other with equal peripheral spaces therebetween.

7. A spark plug as claimed in claim 2, wherein said ground electrode comprises at least three leg portions extending from an integrally connected central portion and welded to said metal part.

* * * * *